US008770692B2

(12) United States Patent
Van Brocklin et al.

(10) Patent No.: US 8,770,692 B2
(45) Date of Patent: Jul. 8, 2014

(54) CROSSTALK REDUCTION IN PIEZO PRINTHEAD

(75) Inventors: Andrew L. Van Brocklin, Corvallis, OR (US); Neel Banerjee, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 253 days.

(21) Appl. No.: 13/258,758

(22) PCT Filed: Jan. 29, 2010

(86) PCT No.: PCT/US2010/022641

§ 371 (c)(1),
(2), (4) Date: Sep. 22, 2011

(87) PCT Pub. No.: WO2011/093889

PCT Pub. Date: Aug. 4, 2011

(65) Prior Publication Data

US 2012/0019578 A1 Jan. 26, 2012

(51) Int. Cl.
*B41J 29/38* (2006.01)

(52) U.S. Cl.
USPC ..... 347/10; 347/11; 347/5

(58) Field of Classification Search
USPC ..... 347/5, 10, 57, 11, 9
IPC ..... B41J 20/0454
See application file for complete search history.

(56) References Cited

U.S. PATENT DOCUMENTS

| | | | | |
|---|---|---|---|---|
| 4,266,232 | A | 5/1981 | Juliana, Jr. et al. | |
| 4,459,599 | A | 7/1984 | Ort | |
| 4,521,786 | A | 6/1985 | Bain | |
| 5,541,628 | A | 7/1996 | Chang et al. | |
| 5,815,172 | A | 9/1998 | Moh | |
| 6,257,687 | B1 | 7/2001 | Iwamura | |
| 6,382,754 | B1 | 5/2002 | Morikoshi et al. | |
| 6,390,579 | B1 | 5/2002 | Roylance et al. | |
| 6,460,979 | B1 | 10/2002 | Heinzl et al. | |
| 6,608,426 | B2 | 8/2003 | Hayashi et al. | |
| 6,719,390 | B1 | 4/2004 | Howkins et al. | |
| 6,733,099 | B2 | 5/2004 | Masumoto | |
| 6,814,419 | B2 | 11/2004 | Yazdy | |
| 6,830,302 | B2 | 12/2004 | Masumoto et al. | |
| 6,998,928 | B2 | 2/2006 | Stengel et al. | |
| 7,252,355 | B2 | 8/2007 | Umeda | |
| 7,300,126 | B2 * | 11/2007 | Uraki et al. | 347/10 |
| 7,334,856 | B2 | 2/2008 | Hamazaki et al. | |

(Continued)

FOREIGN PATENT DOCUMENTS

| | | | |
|---|---|---|---|
| EP | 0936069 | A2 | 8/1999 |
| EP | 1378360 | A1 | 7/2004 |

(Continued)

OTHER PUBLICATIONS

Supplementary European Search Report for Application No. 10844889.5. Report issued Aug. 27, 2013.

*Primary Examiner* — Lam S Nguyen
(74) *Attorney, Agent, or Firm* — Nathan R. Rieth

(57) ABSTRACT

Crosstalk in a piezo printhead is reduced by storing a coefficient that expresses an amount of crosstalk between a first nozzle and an adjacent nozzle. A drive waveform voltage is pre-biased using the coefficient, and the pre-biased waveform is applied to a piezoelectric material of the first nozzle.

9 Claims, 12 Drawing Sheets

(56) References Cited

U.S. PATENT DOCUMENTS

| | | | |
|---|---|---|---|
| 7,448,708 | B2 | 11/2008 | Nakayama |
| 2002/0008441 | A1 | 1/2002 | Nariai |
| 2002/0036666 | A1 | 3/2002 | Taki |
| 2002/0097285 | A1 | 7/2002 | Ishizaki |
| 2003/0151636 | A1 | 8/2003 | Masumoto |
| 2004/0032436 | A1 | 2/2004 | Masumoto |
| 2004/0085090 | A1 | 5/2004 | Yazdy |
| 2004/0085399 | A1 | 5/2004 | Ahne |
| 2005/0116069 | A1 | 6/2005 | Murata |
| 2007/0195116 | A1 | 8/2007 | Kim et al. |
| 2007/0236521 | A1 | 10/2007 | Kondoh |
| 2009/0066738 | A1 | 3/2009 | Seto |

FOREIGN PATENT DOCUMENTS

| | | | |
|---|---|---|---|
| EP | 1707362 | A2 | 4/2006 |
| JP | 1982-178875 | | 11/1982 |
| JP | 1987-116154 | | 5/1987 |
| JP | 1992-357036 | | 12/1992 |
| JP | 1993-504738 | | 7/1993 |
| JP | 2000127408 | A | 5/2000 |
| JP | 2003-226009 | | 8/2003 |
| JP | 2006-041049 | | 2/2006 |
| JP | 2007-112062 | | 5/2007 |
| WO | WO9525011 | | 9/1995 |

* cited by examiner

Compensated Vnozzle voltage waveforms.

Membrane displacements after compensation by electrical compensation model.

CROSSTALK REDUCTION IN PIEZO PRINTHEAD

BACKGROUND

Drop on demand (DOD) piezo printheads are utilized widely to print on a variety of substrates. Piezo printheads are favored versus thermal inkjet printheads when using jetable materials such as UV curable printing inks whose higher viscosity or chemical composition prohibits the use of thermal inkjet for their DOD application. Thermal inkjet printheads use a heating element actuator in an ink-filled chamber to vaporize ink and create a bubble which forces an ink drop out of a nozzle. Thus, the jetable materials suitable for use in thermal inkjet printheads are limited to those whose formulations can withstand boiling temperature without mechanical or chemical degradation. Piezo printheads can accommodate a wider selection of jetable materials, however, as they use a piezoelectric material actuator on a membrane of an ink-filled chamber to generate a pressure pulse which forces a drop of ink out of the nozzle.

However, one problem that piezoelectric printheads have is mechanical crosstalk between adjacent nozzles. When the membrane in a given nozzle moves up, the membranes in adjacent nozzles move down by some lesser distance. This affects the operation of the adjacent nozzles negatively. Ideally, when a given nozzle is actuated (moving its membrane up or down), the membranes in adjacent nozzles would not be affected. Rather, membranes in adjacent nozzles would be completely independent and would not move detectably when neighboring nozzles are actuated and their membranes move.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
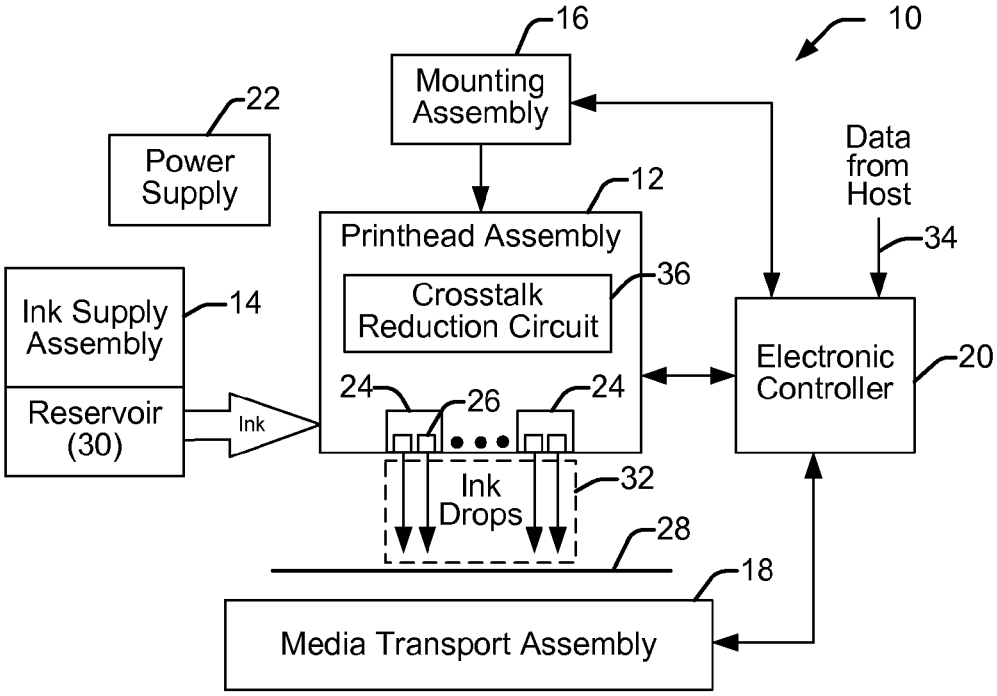
FIG. 1 shows an inkjet printing system according to an embodiment.

As noted above, mechanical crosstalk between adjacent nozzles in a piezoelectric printhead has an adverse effect on the operation of the printhead. Mechanical crosstalk occurs primarily through a common mechanical membrane that moves in response to applied voltages to a connected piezoelectric material. The membrane is often made of a relatively thick sheet of silicon (e.g., 20-50 microns) which is shared by tightly packed fluid chambers. The membrane is stiff in order to accommodate a high frequency of drop ejection. The tightly packed chambers and stiffness of the membrane cause mechanical crosstalk between adjacent nozzles as movement in the membrane at one nozzle pulls against the membrane in adjacent nozzles. Actuation of a nozzle causes the membrane at that nozzle to deflect in a direction that decreases the volume of the chamber and forces a drop out of the nozzle. The membrane displacement at the actuated nozzle results in undesired displacement in an opposite direction of the membrane in adjacent nozzles (i.e., mechanical crosstalk). The resulting volume changes in adjacent chambers caused by the undesired membrane displacement may adversely affect the drop ejection process in the adjacent chambers.

Previous solutions to the problem of mechanical crosstalk between adjacent nozzles in piezoelectric printheads include idling every other nozzle such that an idle chamber is present between every two active nozzles. Thus, the printhead fires only every other nozzle at once. The main disadvantage with this approach is that the printhead productivity/speed is reduced by half. Thus, twice the number of printheads would be necessary in a printer implementing this solution to achieve the same print speed in a printer not needing such a solution.

Other partial solutions include cutting the piezo material completely between nozzles and/or thinning the membrane. However, the additional process steps needed to completely cut the piezo material between nozzles add significant costs. When thinning the membrane, limitations in the machinery available to grind the membrane necessitate minimum membrane thicknesses in order to provide a consistent yield.

Embodiments of the present disclosure overcome disadvantages such as those mentioned above, generally by compensating the drive voltage of a nozzle by an amount corresponding to the amount of crosstalk between adjacent nozzles. A coefficient is stored that describes the amount of mechanical crosstalk affecting the membrane between nozzles. Circuitry uses the stored coefficient to pre-bias the piezoelectric drive waveform voltage to create movement on the membrane that is nearly or exactly matching the desired direct response expected from the original drive voltage. Drive waveform voltages are adjusted in real time to minimize crosstalk.

In one example embodiment, a method to reduce crosstalk in a piezo printhead includes storing a coefficient that expresses an amount of crosstalk between a first nozzle and an adjacent nozzle. A drive waveform is pre-biased using the stored coefficient, and the pre-biased drive waveform is applied to a piezoelectric material of the first nozzle. In another embodiment, a printhead assembly includes a crosstalk reduction circuit to transform a voltage drive waveform of a first nozzle to compensate for crosstalk from an adjacent nozzle. In one embodiment, the crosstalk reduction circuit includes a storage element to store a coefficient that expresses an amount of crosstalk, a multiplier to generate a compensation product from the coefficient and an adjacent drive waveform voltage, and a summing element to sum the compensation product to a first drive waveform voltage associated with the first nozzle. In still another embodiment, a method to reduce crosstalk in a piezo printhead includes compensating a first drive waveform voltage for a first nozzle by a factor representing a first amount of crosstalk between the first nozzle and an adjacent nozzle, where the first amount of crosstalk is associated with a second drive waveform voltage for the adjacent nozzle. In one embodiment, the compensating includes multiplying the second drive waveform voltage by a crosstalk coefficient that expresses a degree of crosstalk between adjacent nozzles to determine the first factor, and summing the first factor with the first drive waveform to form a compensated drive waveform.

Illustrative Embodiments

FIG. 1 illustrates one embodiment of an inkjet printing system 10. Inkjet printing system 10 includes an inkjet printhead assembly 12, an ink supply assembly 14, a mounting assembly 16, a media transport assembly 18, an electronic controller 20, and at least one power supply 22 which provides power to the various electrical components of inkjet printing system 10. Inkjet printhead assembly 12 includes at least one printhead or printhead die 24 that ejects drops of ink through a plurality of orifices or nozzles 26 and toward a print medium 28 so as to print onto print medium 28. Print medium 28 is any type of suitable sheet material, such as paper, card stock, transparencies, Mylar, and the like. Typically, nozzles 26 are arranged in one or more columns or arrays such that properly sequenced ejection of ink from nozzles 26 causes characters, symbols, and/or other graphics or images to be printed upon print medium 28 as inkjet printhead assembly 12 and print medium 28 are moved relative to each other.

Ink supply assembly 14 supplies ink to printhead assembly 12 and includes a reservoir 30 for storing ink. As such, ink flows from reservoir 30 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 30 of ink supply assembly 14 may be removed, replaced, and/or refilled. In one embodiment, where inkjet printhead assembly 12 and ink supply assembly 14 are housed together in an inkjet cartridge, reservoir 30 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18, and media transport assembly 18 positions print medium 28 relative to inkjet printhead assembly 12. Thus, a print zone 32 is defined adjacent to nozzles 26 in an area between inkjet printhead assembly 12 and print medium 28. In one embodiment, inkjet printhead assembly 12 is a scanning type printhead assembly. As such, mounting assembly 16 includes a carriage for moving inkjet printhead assembly 12 relative to media transport assembly 18 to scan print medium 28. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 28 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 34 from a host system, such as a computer, and includes memory for temporarily storing data 34. Typically, data 34 is sent to inkjet printing system 10 along an electronic, infrared, optical, or other information transfer path. Data 34 represents, for example, a document and/or file to be printed. As such, data 34 forms a print job for inkjet printing system 10 and includes one or more print job commands and/or command parameters.

In one embodiment, electronic controller 20 controls inkjet printhead assembly 12 for ejection of ink drops from nozzles 26. As such, electronic controller 20 defines a pattern of ejected ink drops which form characters, symbols, and/or other graphics or images on print medium 28. The pattern of ejected ink drops is determined by the print job commands and/or command parameters.

In one embodiment, inkjet printhead assembly 12 includes one printhead 24. In another embodiment, inkjet printhead assembly 12 is a wide-array or multi-head printhead assembly. In one wide-array embodiment, inkjet printhead assembly 12 includes a carrier, which carries printhead dies 24, provides electrical communication between printhead dies 24 and electronic controller 20, and provides fluidic communication between printhead dies 24 and ink supply assembly 14.

Figure 2:
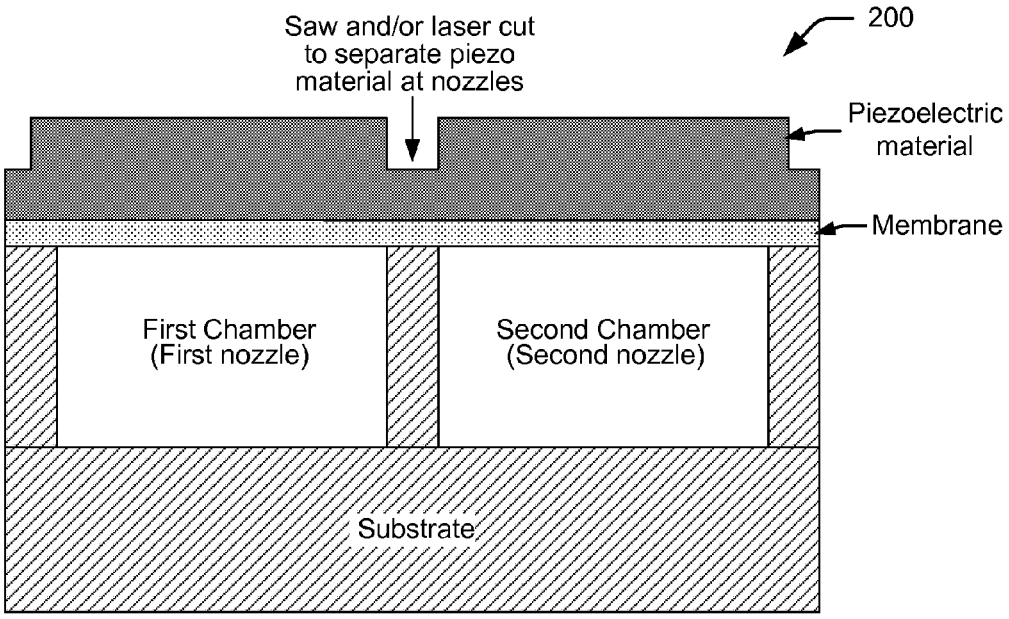
FIG. 2 shows piezoelectric side shooter chambers in a printhead assembly according to an embodiment.

In one embodiment, inkjet printing system 10 is a drop-on-demand piezoelectric inkjet printing system 10. As such, a piezoelectric printhead assembly 12 includes a crosstalk reduction circuit 36, discussed in greater detail herein below. A piezoelectric printhead assembly 12 in a piezoelectric inkjet printing system 10 includes piezo chambers formed in a printhead die 24, such as the piezo side shooter chambers 200 illustrated in FIG. 2. In the piezo chambers 200 of FIG. 2, no actuation of the piezo material is taking place. The membrane is configured to move up and down to increase and decrease the volume of the chamber, and the jetable material (e.g., ink) ejects out of the page toward the viewer. The refill structure (not shown) is behind the chamber and the nozzle structure (not shown) is in front of the chamber, toward the viewer.

Figure 3:
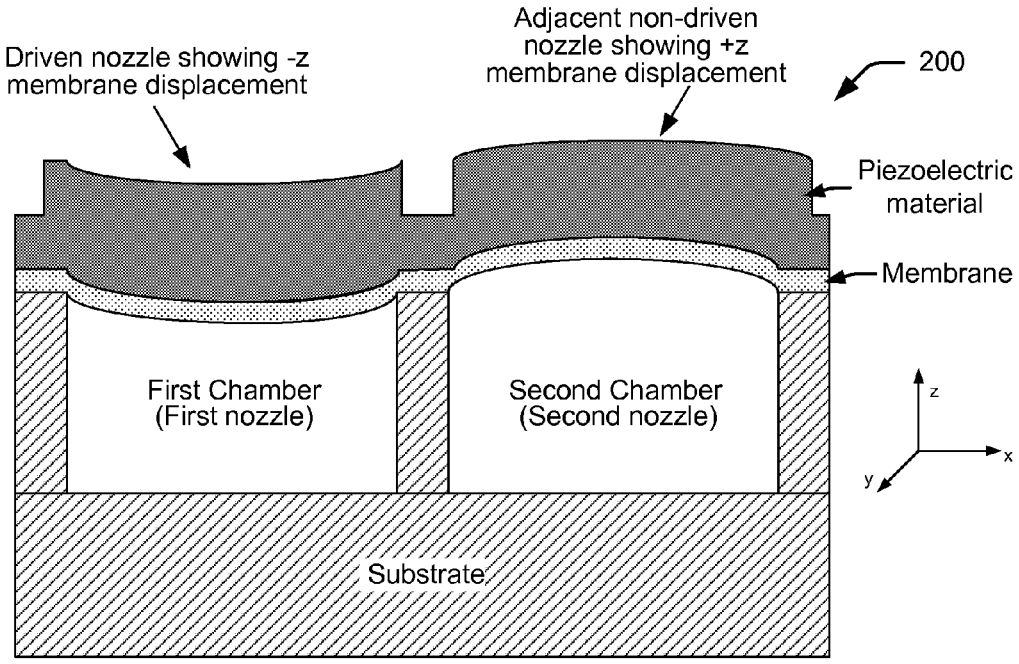
FIG. 3 shows the actuation of a piezo chamber through the application of a voltage to piezoelectric material according to an embodiment.

Actuation of a piezo chamber 200 occurs when a voltage is applied to the piezoelectric material associated with the chamber. FIG. 3 illustrates the actuation of the first chamber (i.e., driving of the first nozzle) through the application of a voltage to the piezoelectric material above the first chamber. Actuation of the piezoelectric material causes the piezo material to deform in the −z direction which results in a corresponding displacement of the adjoining membrane in the −z direction (the deformation and displacement are exaggerated in the illustration for the purpose of this description). Displacement of the membrane into the chamber reduces the chamber volume, causing the ejection of a drop of ink from the first chamber, through the first nozzle (not shown).

FIG. 3 further illustrates the well-known effect of mechanical crosstalk between adjacent piezo chambers 200. As the membrane over the first chamber displaces in the −z direction during the actuation of the first nozzle, it pulls against the membrane (i.e., the membrane pulls against itself) over adjacent chambers, such as the second chamber shown in FIG. 3. This pulling causes the membrane over the adjacent chambers to displace in the opposite direction (i.e., +z direction). Since the amount of crosstalk affecting a given nozzle is a contribution of crosstalk from all adjacent nozzles, the crosstalk magnitude for a given nozzle is stated as the sum of the contributions from all the adjacent nozzles. For example, in FIGS. 1 and 2 there are only two adjacent nozzles to any given nozzle due to the linear nature of the example array illustrated. In such a linear array of nozzles, assuming a crosstalk coefficient of 0.15 describes the amount of crosstalk to affect a given nozzle from an applied movement in an adjacent nozzle, the total possible crosstalk in a given nozzle would be 2*15%=30% crosstalk. Thus, in a line of 3 adjacent nozzles where the outer 2 nozzles are driven simultaneously to an arbitrary membrane displacement of 1, the middle nozzle membrane experiences a membrane displacement of −0.3. In one case of a 2-dimensional array of nozzles, for example, where each nozzle has 4 adjacent nozzles, a crosstalk coefficient of 0.15 creates a total possible crosstalk in a given nozzle of 4*15%=60%.

Figure 4:
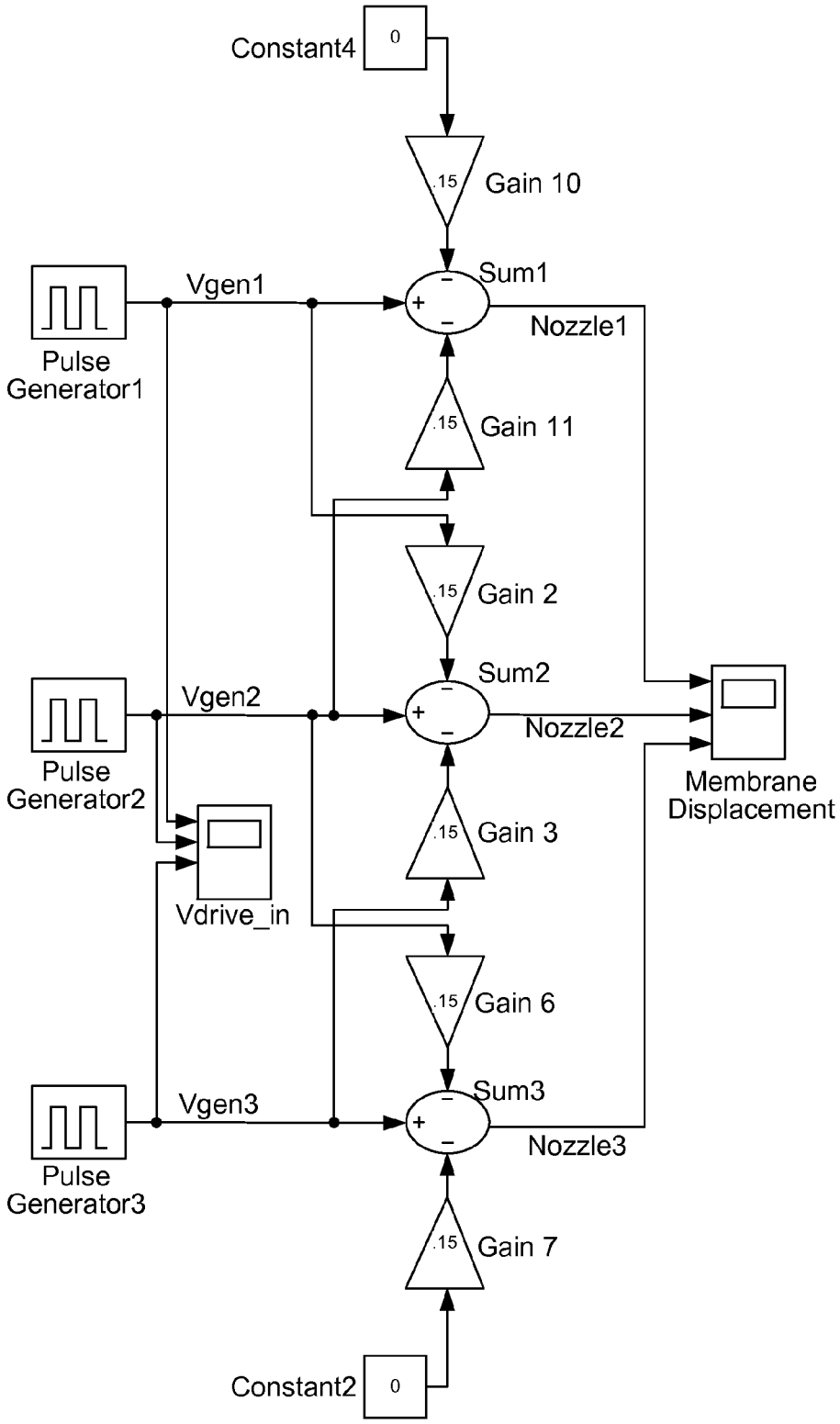
FIG. 4 shows a mechanical model of crosstalk that occurs between piezo chambers of adjacent nozzles in a piezoelectric inkjet printing system according to an embodiment.

FIG. 4 illustrates a mechanical model of crosstalk that occurs between the piezo chambers of adjacent nozzles in a piezoelectric inkjet printing system 10. The model is demonstrated using linearly adjacent nozzles. Although only three nozzles are shown, the model contemplates any number of adjacent nozzles as indicated in part, by the constants (Constant2 and Constant4) discussed below. Pulse generators (1, 2, 3) represent voltages (Vgen1, Vgen2, Vgen3) as would be shown on a measuring scope represented by scope symbol Vdrive_in. The voltages, Vgen1, Vgen2 and Vgen3, are driven onto respective piezoelectric material actuators in a piezoelectric printhead assembly 12. The membrane displacement at each nozzle output (Nozzle1, Nozzle2, Nozzle3) represents an amount of displacement of each membrane caused both by respective input voltages Vgen1, Vgen2, Vgen3, and by crosstalk from adjacent nozzles. The displacement is measurable at a measurement device, Membrane Displacement. The constants, Constant2 and Constant4, indicate whether or not adjacent nozzles above nozzle1 and below nozzle3 are being fired. The mechanical crosstalk model is unitless, in that there is no scaling factor between an arbitrary input voltage and the amount of membrane displacement generated. Thus, for this model both the input voltages (Vgen1, Vgen2, Vgen3) and the output membrane displacements (Nozzle1, Nozzle2, Nozzle3) are assumed to range on a unitless basis from zero to one, with an unscaled electrical to mechanical transition in between the voltage inputs and the membrane displacement outputs.

In the mechanical crosstalk model of FIG. 4, Gain blocks (2, 3, 6, 7, 10, 11) are crosstalk coefficients that represent an amount of crosstalk caused by adjacent nozzles as a percentage of the input voltage waveforms driving those adjacent nozzles. The crosstalk between nozzles is summed at respective summing elements, Sum1, Sum2, Sum3. Thus, for example, if all three nozzles are being driven by an input voltage drive waveform pulse of 1 (i.e., Vgen1, Vgen2, Vgen3 all are 1), the mechanical displacement of the membrane at Nozzle2 is the sum of 1−(0.15*1)−(0.15*1)=0.7. That is, Nozzle2 would be firing at 70% capacity. This is because Vgen2, which drives the Nozzle2 membrane in a positive displacement, is summed at Sum2 with the negative displacements of (0.15*Vgen1) and (0.15*Vgen3). Thus, the positive displacements being generated in the Nozzle1 and Nozzle3 membranes by Vgen1 and Vgen3, respectively, cause negative crosstalk displacements at the membrane of Nozzle2 in an amount determined by the percentage gain (i.e., crosstalk coefficient) noted in the Gain blocks. Note that the constants, Constant2 and Constant4, have a value of zero which indicates that the adjacent nozzles above nozzle1 and below nozzle3 (not shown) are not being fired. As such, the adjacent nozzles above nozzle1 and below nozzle3 (not shown) do not contribute any crosstalk that would otherwise affect the membranes of nozzle1 and nozzle3. Furthermore, it is worth noting that if the value in the Gain blocks is 0.0 (i.e., setting the crosstalk coefficient to zero), the mechanical crosstalk model shows that the membrane displacement at the output of Nozzle2 would be 1, or 100%, regardless of which adjacent nozzles were also being fired.

Figure 5:
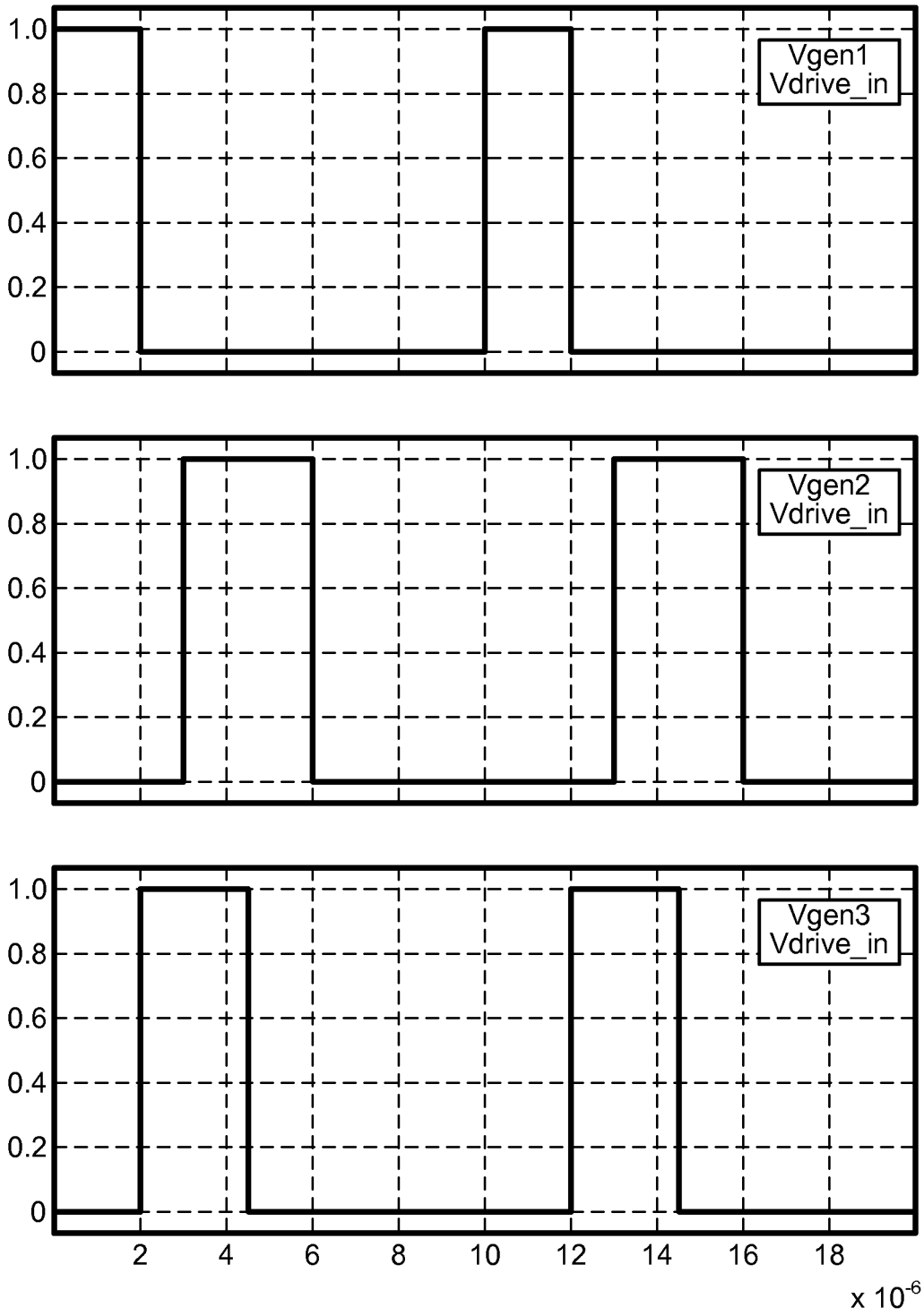
FIG. 5 shows input voltage drive waveforms according to an embodiment.
Figure 6:
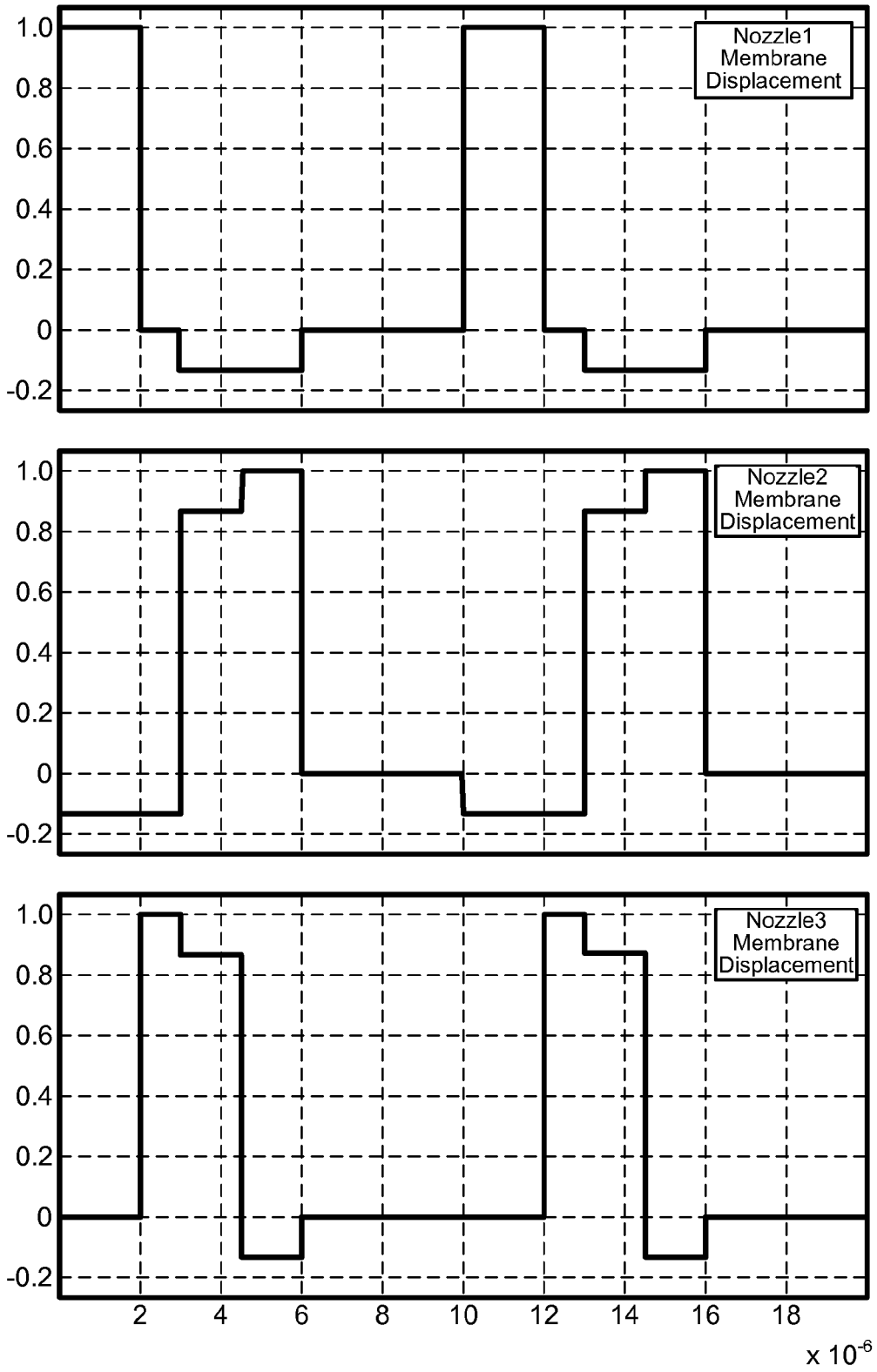
FIG. 6 shows membrane displacement output waveforms according to an embodiment.

FIGS. 5 and 6 are, respectively, voltage drive waveforms and membrane displacement output waveforms that illustrate the results of the mechanical crosstalk model of FIG. 4 when driving the three nozzles in an arbitrary firing sequence. FIG. 5 shows the input voltage drive waveforms for Vgen1, Vgen2, and Vgen3, which are firing the respective nozzles (Nozzle1, Nozzle2, Nozzle3). The input voltage drive waveforms Vgen1, Vgen2, and Vgen3, are single firing pulses of slightly different delays and widths which illustrate the technique of the mechanical crosstalk model.

The membrane displacement output waveforms shown in FIG. 6 represent the movement of the membranes that is output from the summing functions (Sum1, Sum2, Sum3) for Nozzle1, Nozzle2, and Nozzle3 of the FIG. 4 crosstalk model. Between adjacent nozzles, the crosstalk causes a 15% distortion between the actual movement of the nozzle membrane and the expected movement of the nozzle membrane. For simultaneous firing of the nozzles, up to a 30% reduced membrane displacement can be encountered from dual side crosstalk.

Figure 7:
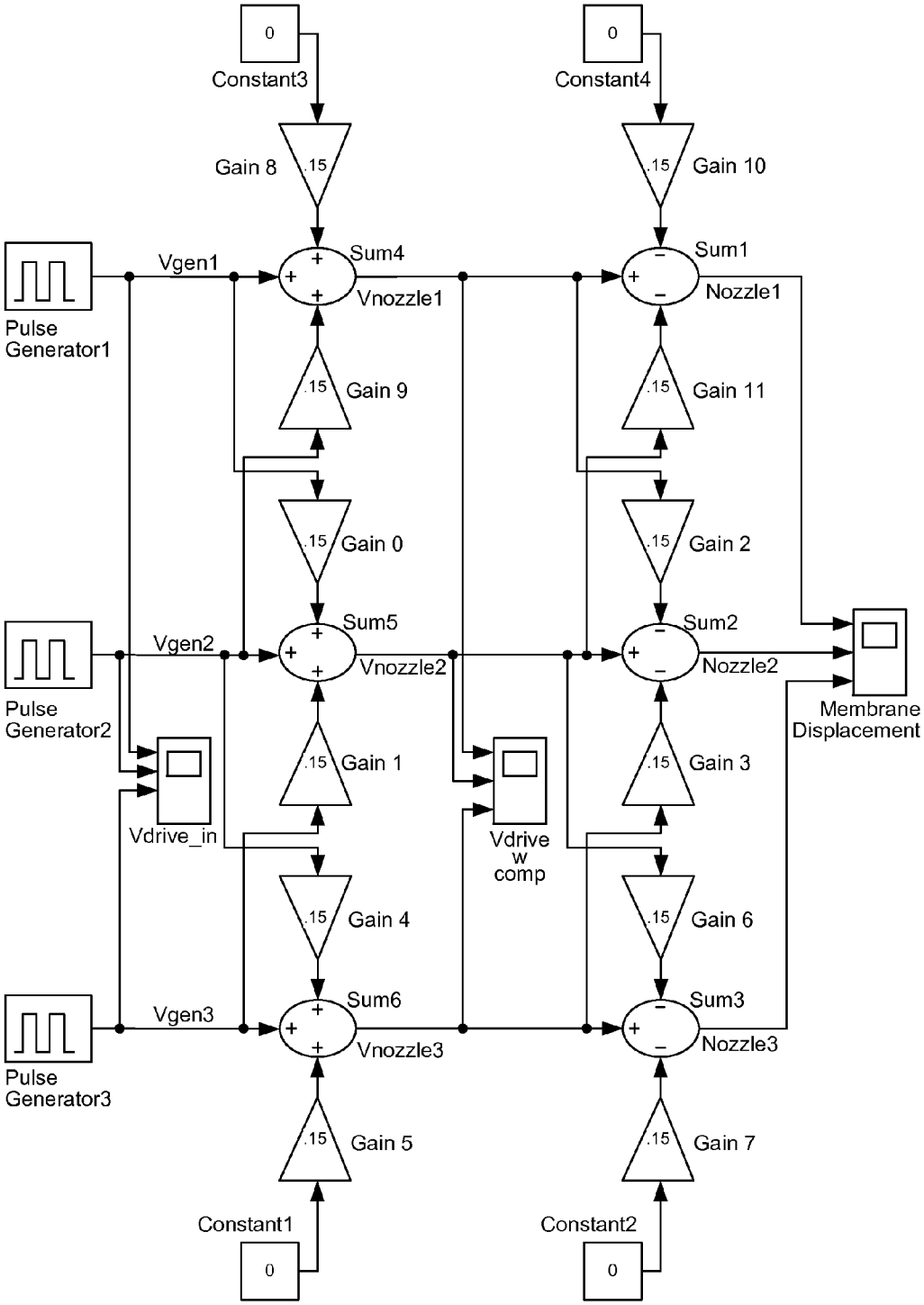
FIG. 7 shows the mechanical model of FIG. 4 coupled with an electrical compensation model that provides a first order reduction in mechanical crosstalk according to an embodiment.

FIG. 7 illustrates the addition of an electrical compensation model to the mechanical crosstalk model of FIG. 4. This model provides a first order reduction in the mechanical crosstalk demonstrated by the mechanical crosstalk model of FIG. 4. The electrical compensation model adds an electrical compensation circuit representation on to the front end of the mechanical model to demonstrate the first order reduction in mechanical crosstalk by using this circuit representation. As such, the right side of the FIG. 7 model (i.e., with summation elements, Sum1, Sum2 and Sum3), represents the mechanical crosstalk model discussed above from FIG. 4, while the middle portion of model (i.e., with summation elements, Sum4, Sum5 and Sum6) represents the electrical compensation circuit model. In general, the electrical compensation model pre-biases, or applies a transformation to the input voltage drive waveforms for each nozzle. The voltage transformation compensates for the crosstalk caused by membrane displacements in adjacent nozzles resulting from the voltage waveforms which drive those adjacent nozzles.

To demonstrate the electrical compensation model of FIG. 7, it can be assumed that voltage drive pulses are being applied at Vgen1, Vgen2 and Vgen3. The mechanical model constants, Constant2 and Constant4, have a value of zero which indicates that adjacent nozzles above nozzle1 and below nozzle3 (not shown) are not being fired and will therefore not contribute any crosstalk distortion. Accordingly, the electrical model constants, Constant1 and Constant3, also have a value of zero which results in no crosstalk compensation being summed in for the non-firing nozzles. Beginning with the Sum5 summing element, the Vgen2 voltage input drive waveform is summed with scaled voltage drive waveforms from the two adjacent nozzles. That is, the Vgen2 voltage input drive waveform is summed to 15% of the Vgen1 voltage input drive waveform and 15% of the Vgen3 voltage input drive waveform according to the crosstalk coefficient shown in the Gain blocks, Gain 0 and Gain 1, whose value in this instance is 0.15. As such, the Vgen2 voltage input drive waveform has been pre-biased using the crosstalk coefficient and transformed or compensated (i.e., increased) at Sum5 into the resulting Vnozzle2 drive voltage which drives the Nozzle2 membrane and accounts for the negative membrane displacement (i.e., the crosstalk distortion) that occurs from the movement of the Nozzle1 and Nozzle3 membranes. Vnozzle2 represents the compensated voltage drive waveform (as measured at Vdrive_w_comp; "voltage drive with compensation") that reduces the effect of crosstalk from membrane displacements in the adjacent nozzles (Nozzle1 and Nozzle3), such that the displacement of the membrane at Nozzle2 will be exactly or nearly the same as it is intended to be from the Vgen2 voltage input drive waveform.

Figure 8:
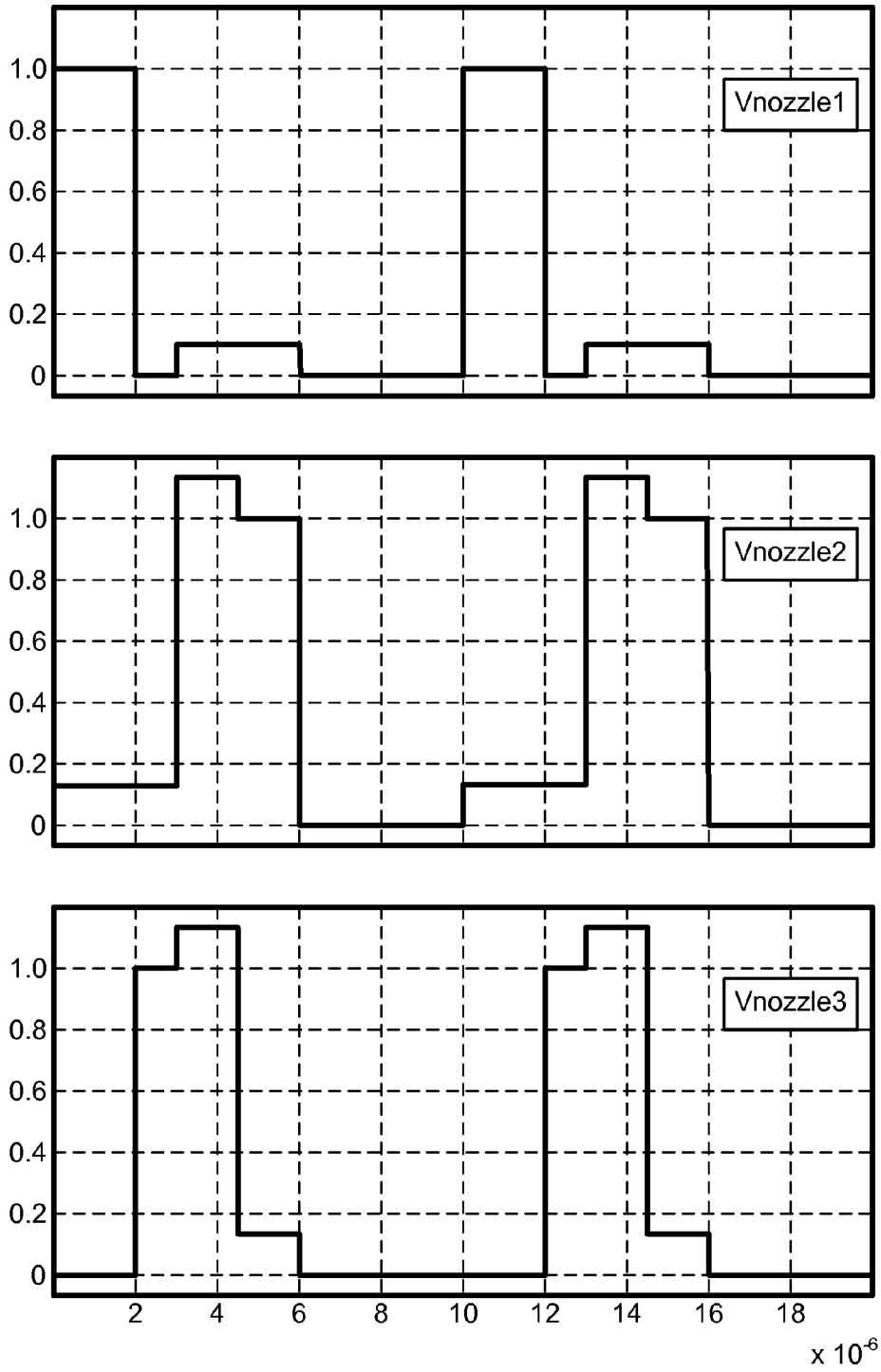
FIG. 8 shows added drive voltage in voltage drive waveforms due to crosstalk compensation according to an embodiment.
Figure 9:
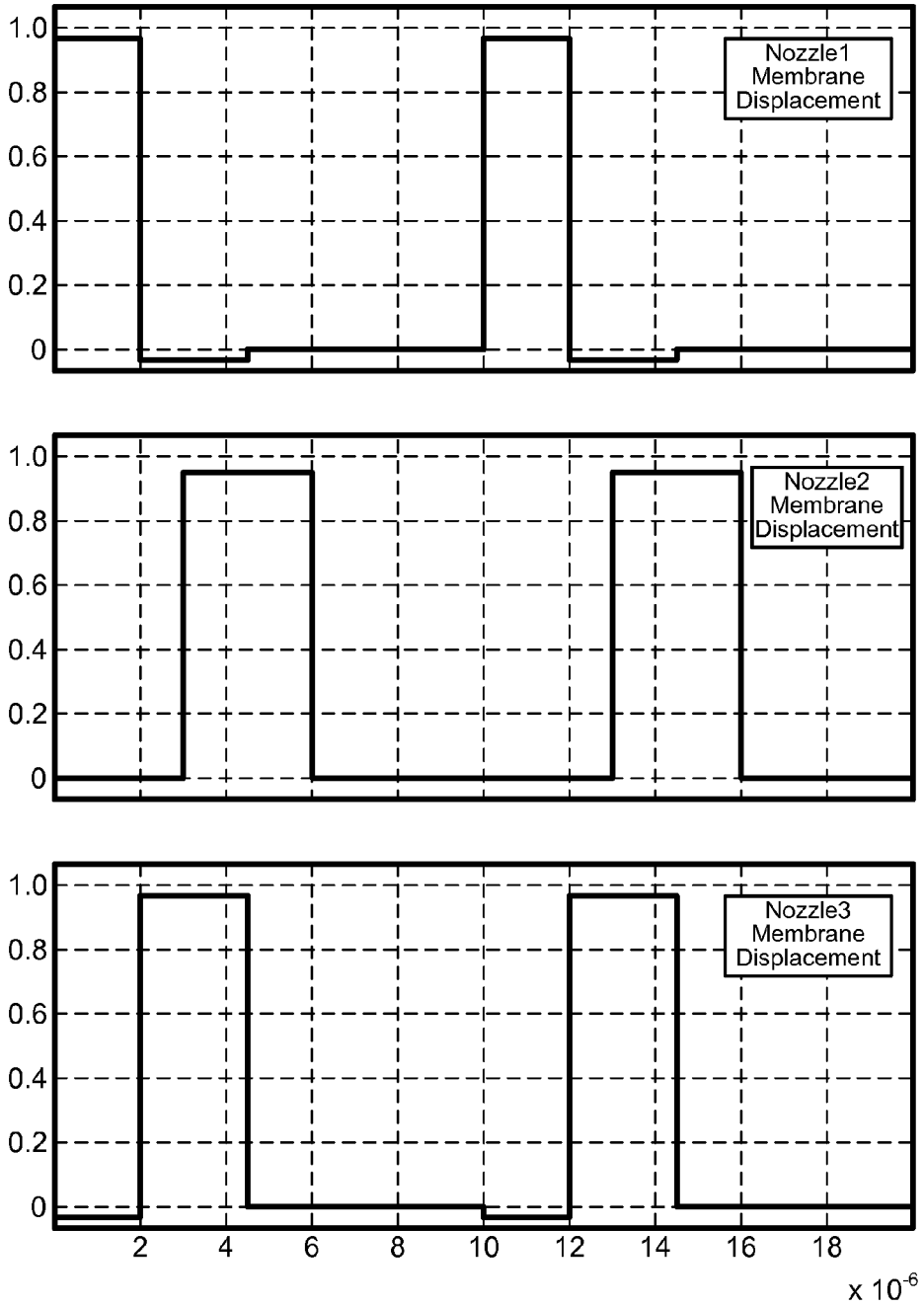
FIG. 9 shows membrane displacement waveforms according to an embodiment.

FIGS. 8 and 9 show, respectively, the compensated nozzle voltage waveforms for the three nozzles (i.e., Vnozzle1, Vnozzle2, Vnozzle3), and the membrane displacement waveforms for the three nozzles (i.e., Nozzle1, Nozzle2, Nozzle3) for the electrical compensation model of FIG. 7 that result from the same input voltage drive waveforms (Vgen1, Vgen2, and Vgen3) provided in FIG. 5. FIG. 8 shows the added drive voltage in the resulting Vnozzle waveforms due to crosstalk compensation. That is, the Vgen input voltage drive waveforms (FIG. 5) have been compensated by the electrical compensation model, resulting in the compensated Vnozzle voltage waveforms. Moreover, a comparison of the membrane displacement waveforms in FIGS. 6 and 9 for the three nozzles (i.e., Nozzle1, Nozzle2, Nozzle3), shows the significant reduction in crosstalk distortion provided by the added drive voltage from the electrical compensation model of FIG. 7.

Figure 10:
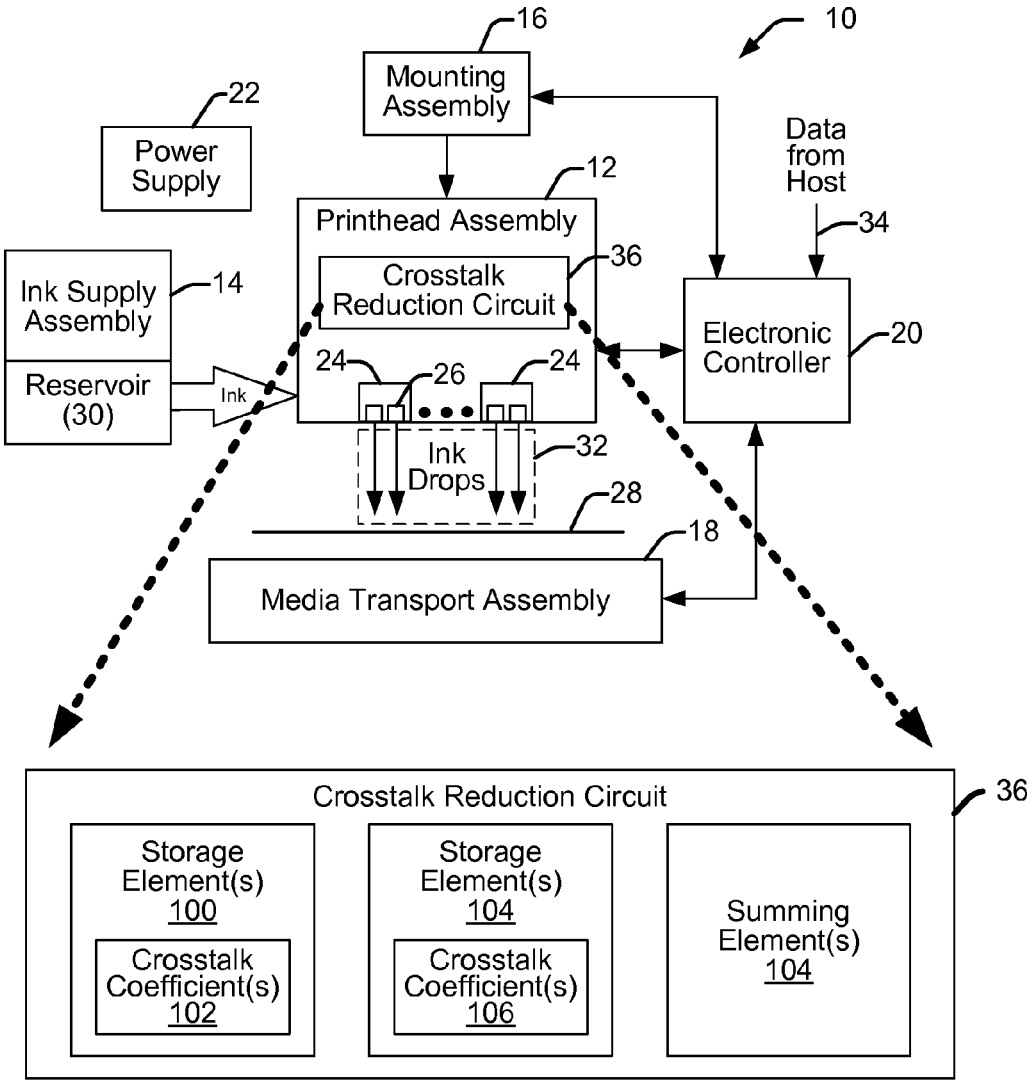
FIG. 10 shows components of a crosstalk reduction circuit that enable an electrical compensation model according to an embodiment.

Referring again back to FIG. 1, the crosstalk reduction circuit 36 enables the functions as described above in the electrical compensation model of FIG. 7. FIG. 10 illustrates components of the crosstalk reduction circuit 36 that enable the electrical compensation model. One or more storage elements 100 provide storage and access to a crosstalk coefficient(s) 102 such as discussed above with respect to the Gain blocks (0, 1, 4, 5, 8, 9), where the crosstalk coefficient 102 expresses an amount of crosstalk between adjacent nozzles. For example, one or more storage elements 100 provide storage and access to a crosstalk coefficient 102 having a value of 0.15, or some other value. One or more multiplying elements 104 enable the generation of compensation products 106 from a coefficient 102 and an adjacent drive waveform voltage associated with an adjacent nozzle. For example, as discussed above, a multiplying element 104 (e.g., a Gain block, 0, 1, 4, 5, 8, 9) enables a compensation product 106 of 0.15*Vgen1, which is the voltage drive waveform from an adjacent nozzle scaled, or multiplied, by the crosstalk coefficient, 0.15. One or more summing elements 108 enable the summing function of Sum4, Sum5 and Sum6 as discussed above in order to sum the compensation product to a first drive waveform voltage associated with a first nozzle. For example, a summing element such as Sum5 sums a compensation product of 0.15*Vgen1 with the Vgen2 drive waveform.

The crosstalk reduction circuit 36 is illustrated in FIG. 1 as being part of the printhead assembly 12, but also being separated from the printhead die 24. As such, the crosstalk reduction circuit 36 may be implemented, for example, on a separate circuit board of printhead assembly 12 and be coupled to the printhead die 24 through a flex circuit, wire bonding, or some other suitable means of connection. However, the crosstalk reduction circuit 36 may also be an integral part of the printhead die 24. As such, the various components of crosstalk reduction circuit 36 may be integrated onto the printhead die 24 through various conventional integrated circuit fabrication techniques such as electroforming, laser ablation, anisotropic etching, sputtering, dry etch, photolithography, casting, molding, stamping, and machining as are well-known to those skilled in the art.

The components of the crosstalk reduction circuit 36 may be implemented in various ways as are generally well-known to persons skilled in the art. For example, the system may be implemented on a high voltage capable CMOS process such as SGS-Thompson's BCD6s process. Such a process is capable of up to 100V, capable of the drive voltage range for most piezo printing devices. The scaling, or multiplication elements 104 ("Product" block elements with reference to FIG. 11 below) may be implemented as a multiplying capacitor DAC, where an 8 bit coefficient is input digitally into the DAC and the nozzle waveform to scale is used as the DAC reference. The summing elements 108 may be implemented using capacitive coupling. The coefficients for the crosstalk compensation to input into the DACs can be obtained globally during calibration of a particular MEMS die, or in zones of some number of die, or down to individual coefficients for each summation on each nozzle. Zonal coefficients may be the most used, since the mechanical properties tend to vary slowly across a given die. It is expected that the crosstalk is not strictly linear, and that adding a quadratic or other function to the crosstalk coefficients may be needed in some mechanical situations to reduce the amount of effective crosstalk to the desired levels.

Figure 11:
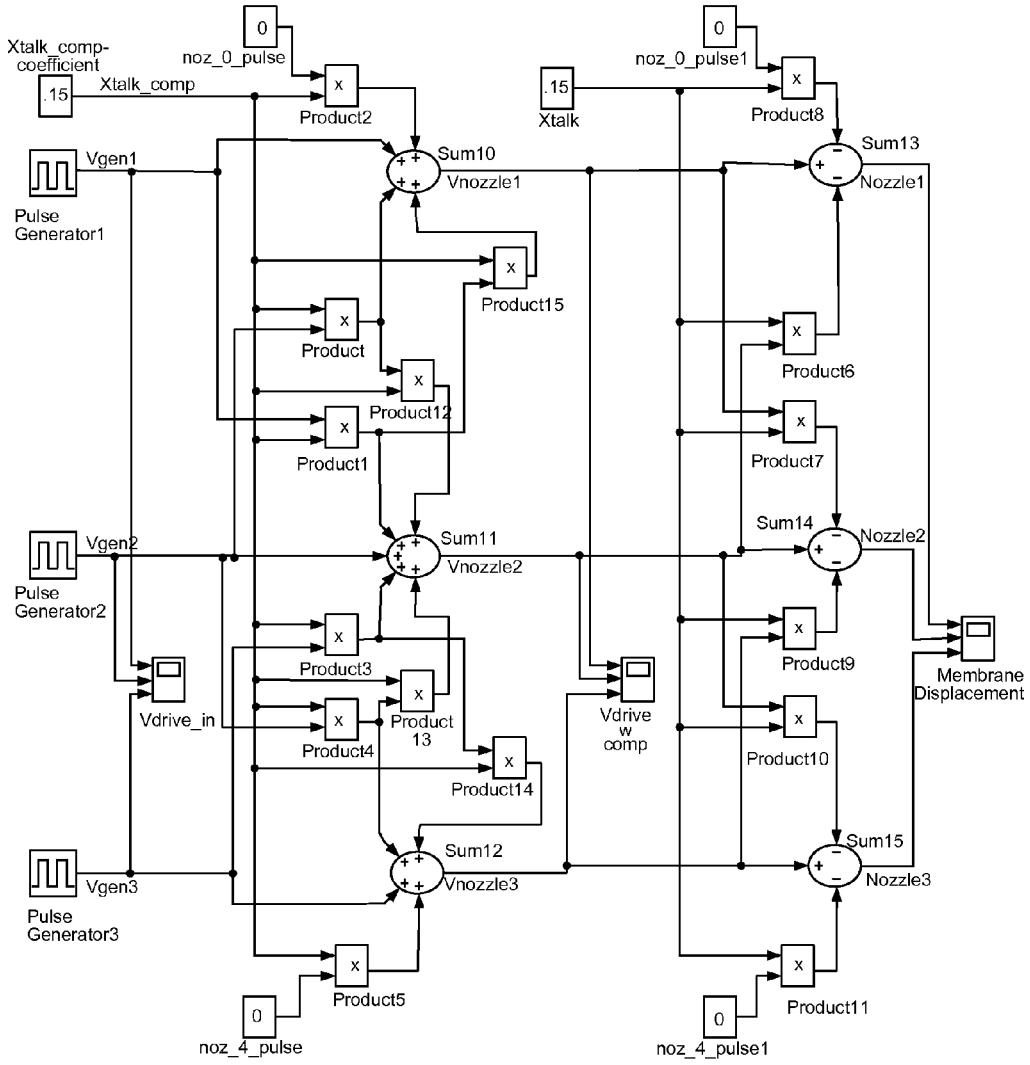
FIG. 11 shows a second order electrical compensation model that provides a second order reduction in mechanical crosstalk according to an embodiment.

FIG. 11 illustrates a second order electrical compensation model that provides a second order reduction in the mechanical crosstalk. The second order electrical compensation model deals with the secondary crosstalk effect caused by the compensation from the first order electrical compensation model of FIG. 7. This secondary crosstalk effect is not significant, but can nonetheless be reduced by more complex circuitry as shown in the FIG. 11 model. The second order electrical compensation model compensates for crosstalk generated from non-adjacent nozzles due to compensation introduced by the first order electrical compensation model of FIG. 7.

The second order model of FIG. 11 is illustrated somewhat differently than the first order model of FIG. 7. For example, the square "Product" blocks (e.g., Product1, Product2, etc.) in FIG. 11 are comparable to the triangular "Gain" blocks in FIG. 7. However, the crosstalk coefficient is not illustrated as being stored in the product blocks themselves, but is rather stored in a separate "Xtalk_comp_coefficient" storage element.

In operation, the summing elements (Sum10, Sum11, Sum12) sum up to five terms instead of three, in order to generate the Vnozzle compensation voltage waveforms. The Sum11 element, for example, sums the input voltage waveform Vgen2, first and second compensation products from Product1 and Product3 blocks, and third and fourth compensation products from Product12 and Product13 blocks. Product1 block multiplies the Xtalk_comp-coefficient (i.e., 0.15 in this case) by the input voltage waveform Vgen1 to generate a first compensation product. Product3 block multiplies the Xtalk_comp-coefficient by the input voltage waveform Vgen3 to generate a second compensation product. Product12 block multiplies the square of the Xtalk_comp-coefficient (i.e., 0.15*0.15) by the input voltage waveform Vgen2 to generate a third compensation product that gets summed in order to compensate for the compensation being applied to adjacent nozzle 1. Product13 block multiplies the square of the Xtalk_comp-coefficient (i.e., 0.15*0.15) by the input voltage waveform Vgen2 to generate a fourth compensation product that gets summed in order to compensate for the compensation being applied to adjacent nozzle 3. As such, a first order compensation term (i.e., Xtalk_comp-coefficient*Vgen) is summed with second order compensation terms (i.e., (Xtalk_comp-coefficient)2*Vgen).

Figure 12:
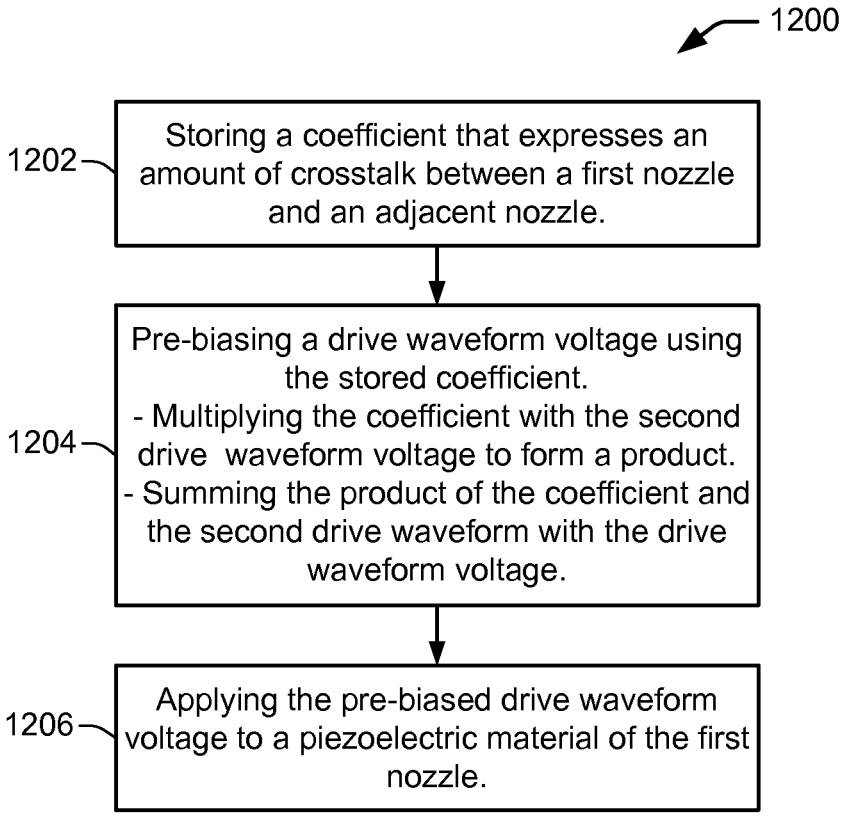
FIG. 12 shows a flowchart of a method of reducing crosstalk in a piezo printhead according to an embodiment.

FIG. 12 shows a flowchart of a method 1200 of reducing crosstalk in a piezo printhead according to an embodiment. Method 1200 is associated with the embodiments of the electrical compensation circuit models discussed above with respect to FIGS. 1-11. Although method 1200 includes steps listed in certain order, it is to be understood that this does not limit the steps to being performed in this or any other particular order.

Method 1200 begins at block 1202 with storing a coefficient. The coefficient is a crosstalk coefficient that expresses an amount of crosstalk between a first nozzle and an adjacent nozzle. At block 1204, a drive waveform voltage is pre-biased using the coefficient. Pre-biasing the drive waveform voltage includes multiplying the coefficient with the second drive waveform voltage to form a product. Pre-biasing further includes summing the product of the coefficient and the second drive waveform with the drive waveform voltage. At block 1206, the pre-biased drive waveform voltage is applied to a piezoelectric material of the first nozzle.

Figure 13:
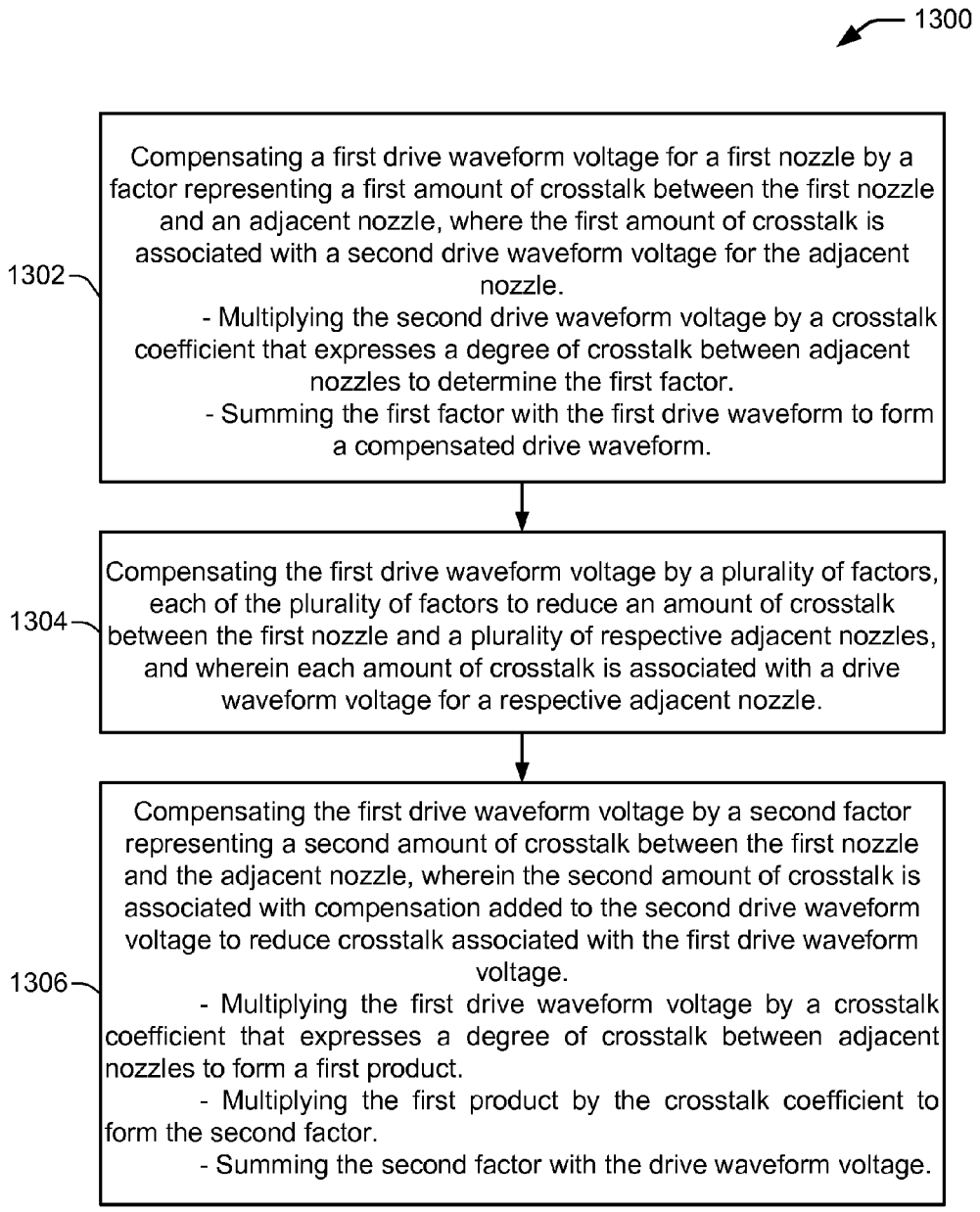
FIG. 13 shows a flowchart of a method of reducing crosstalk in a piezo printhead according to an embodiment.

FIG. 13 shows a flowchart of a method 1300 of reducing crosstalk in a piezo printhead according to an embodiment. Method 1300 is associated with the embodiments of the electrical compensation circuit models discussed above with respect to FIGS. 1-11. Although method 1300 includes steps listed in certain order, it is to be understood that this does not limit the steps to being performed in this or any other particular order.

Method 1300 begins at block 1302 with compensating a first drive waveform voltage for a first nozzle by a first factor representing a first amount of crosstalk between the first nozzle and an adjacent nozzle. The first amount of crosstalk is associated with a second drive waveform voltage for the adjacent nozzle. The compensating includes multiplying the second drive waveform voltage by a crosstalk coefficient that expresses a degree of crosstalk between adjacent nozzles to determine the first factor, and summing the first factor with the first drive waveform to form a compensated drive waveform. The method continues at block 1304, wherein compensating the first drive waveform voltage includes compensating the first drive waveform voltage by a plurality of factors, each of the plurality of factors to reduce an amount of crosstalk between the first nozzle and a plurality of respective adjacent nozzles, wherein each amount of crosstalk is associated with a drive waveform voltage for a respective adjacent nozzle.

The method continues at block 1306 with compensating the first drive waveform voltage by a second factor representing a second amount of crosstalk between the first nozzle and the adjacent nozzle. The second amount of crosstalk is associated with compensation added to the second drive waveform voltage to reduce crosstalk associated with the first drive waveform voltage. Compensating the first drive waveform voltage by a second factor includes multiplying the first drive waveform voltage by a crosstalk coefficient that expresses a degree of crosstalk between adjacent nozzles to form a first product, multiplying the first product by the crosstalk coefficient to form the second factor, and summing the second factor with the drive waveform voltage.

What is claimed is:

1. A method to reduce crosstalk in a piezo printhead comprising:

storing a coefficient that expresses an amount of crosstalk between a first nozzle and an adjacent nozzle;

pre-biasing a drive waveform voltage using the coefficient by summing to the drive waveform voltage, a scaled copy of a second drive waveform voltage for the adjacent nozzle; and applying the pre-biased drive waveform voltage to a piezoelectric material of the first nozzle.

2. A method as recited in claim 1, wherein summing comprises:

multiplying the coefficient with the second drive waveform voltage to form a product; and summing the product and the drive waveform voltage.

3. A method as recited in claim 1, wherein the scaled copy is a product of the coefficient and the second drive waveform voltage for the adjacent nozzle.

4. A method as recited in claim 1, wherein pre-biasing comprises:

multiplying the coefficient squared with the drive waveform voltage to form a second order compensation; and summing to the drive waveform voltage, the scaled copy and the second order compensation.

5. A printhead assembly comprising a crosstalk reduction circuit to transform a voltage drive waveform of a first nozzle to compensate for crosstalk from an adjacent nozzle wherein the crosstalk reduction circuit comprises:

a storage element to store a coefficient that expresses an amount of crosstalk between the first nozzle and the adjacent nozzle;

a multiplier to generate a scaled copy of a second drive waveform voltage for the adjacent nozzle; and a summing element to sum the scaled copy to a first drive waveform voltage associated with the first nozzle.

6. A printhead assembly as recited in claim 5, further comprising:

a second multiplier to generate a compensation product from the compensation product and the coefficient, wherein the summing element is configured to sum the scaled copy and the second compensation product to the first drive waveform.

7. A printhead assembly as recited in claim 5 wherein the crosstalk reduction circuit is fabricated on a circuit board of the printhead assembly and coupled to a printhead die.

8. A printhead assembly as recited in claim 5 wherein the crosstalk reduction circuit is integrated onto a printhead die of the printhead assembly.

9. A printhead assembly as recited in claim 5 wherein the multiplier is to generate the scaled copy by multiplying the coefficient with the second drive waveform voltage to form a product.

* * * * *